US007859425B2

(12) United States Patent
Glasa et al.

(10) Patent No.: US 7,859,425 B2
(45) Date of Patent: Dec. 28, 2010

(54) LIGHT SIGNAL, IN PARTICULAR MARITIME EMERGENCY LIGHT SIGNAL, AND LUMINOUS UNIT FOR A LIGHT SIGNAL

(75) Inventors: Stefan Glasa, Hamburg (DE); Holger Galley, Hamburg (DE); Thorsten Kothe, Achim (DE); Oliver Schultz, Bremerhaven (DE)

(73) Assignee: Chemring Defence Germany GmbH (DE)

( * ) Notice: Subject to any disclaimer, the term of this patent is extended or adjusted under 35 U.S.C. 154(b) by 227 days.

(21) Appl. No.: 11/956,739

(22) Filed: Dec. 14, 2007

(65) Prior Publication Data

US 2008/0150764 A1 Jun. 26, 2008

(30) Foreign Application Priority Data

Dec. 15, 2006 (DE) ..... 20 2006 018 960 U

(51) Int. Cl.
*G08B 23/00* (2006.01)

(52) U.S. Cl. ..... 340/693.5; 340/691.1

(58) Field of Classification Search ..... 340/984, 340/691.1, 693.5

See application file for complete search history.

(56) References Cited

U.S. PATENT DOCUMENTS 1,669,055 A * 5/1928 Hogg ..... 441/16
2,397,844 A * 4/1946 Dewhurst ..... 367/3
3,559,224 A * 2/1971 Shimizu ..... 441/17
3,818,428 A * 6/1974 Phipps et al. ..... 340/984
3,833,955 A * 9/1974 Hulbert, Jr. ..... 441/16
4,464,129 A * 8/1984 Vancheri et al. ..... 441/16
4,736,205 A * 4/1988 Dodge ..... 340/985
4,896,620 A * 1/1990 Jones ..... 114/253
5,029,293 A * 7/1991 Fontanille ..... 340/573.1
5,520,486 A * 5/1996 Van Wyck ..... 405/186
5,800,044 A * 9/1998 Marshall ..... 362/158

* cited by examiner

*Primary Examiner*—Travis R Hunnings
(74) *Attorney, Agent, or Firm*—Smith, Gambrell & Russell

(57) ABSTRACT

The invention provides for exchanging a complete luminous unit (24) instead of exchanging the individual components such as a battery (64). For this purpose, at least one energy-saving light-emitting diode (56) as luminous means, a battery (64) and a magnetically actuable reed contact (66) serving as switching element are combined as luminous unit (24). The use of a cost-effective light-emitting diode (56) and a battery (64) formed in space-saving fashion in accordance with the low power demand of the light-emitting diode (56) permits a compact configuration of the luminous unit (24). The fact that the luminous unit (24) can be inserted into the floating body (22) as a unit and can be exchanged as a unit obviates a complicated battery change or change of luminous means entailing the risk of leaks.

16 Claims, 7 Drawing Sheets

LIGHT SIGNAL, IN PARTICULAR MARITIME EMERGENCY LIGHT SIGNAL, AND LUMINOUS UNIT FOR A LIGHT SIGNAL

STATEMENT OF RELATED APPLICATIONS

This patent application is based on and claims priority on German Patent Application No. 20 2006 018 960.2 having a filing date of 15 Dec. 2006, which is incorporated herein by this reference.

BACKGROUND OF THE INVENTION

1. Technical Field

The invention relates to a light signal, in particular a maritime emergency light signal, comprising a floating body, the floating body being assigned at least one luminous means with an energy source and a switching element for the activation of the luminous means. The invention furthermore relates to a luminous unit for use in a light signal, comprising at least one luminous means, at least one energy source, and at least one switching element.

2. Related Art

For identifying and signaling acute emergency situations at sea, special light signals are used in seafaring and in aviation, said light signals, in the form of floating signal means, usually being able to emit light and possibly smoke for signaling over several hours, such that those light signals can be used for locating persons experiencing a maritime emergency, for example, primarily in darkness. Various designs of light signals are known, such as, for example, so-called night lights or maritime emergency night lights having at least one light source, and so-called maritime emergency light signals or "man overboard" signals (MOB) which have a smoke source in addition to at least one light source.

In the previously known light signals, the cabling, the circuitry and energy supply of the light source are arranged in the interior of the floating body sealed in watertight fashion. The floating body therefore has to be opened for a repair or for exchanging individual components such as, for example, for changing the battery. The subsequent process of sealing the floating body in watertight fashion, which is necessary for reliable and disturbance-free operation, is generally associated with great effort.

The presently conventional use of normal incandescent lamps as luminous means for light signals leads to further disadvantages of known light signals. The latter have normal incandescent lamps, which have only a comparatively short lifetime and have a comparatively high power consumption.

BRIEF SUMMARY OF THE INVENTION

The invention is based on the object of providing a light signal which eliminates the described disadvantages of the prior art, simplifies and improves the construction of the light signal overall, and simplifies in particular the maintenance and handling of the light signal.

A light signal, in particular a maritime emergency light signal, for achieving said object comprises a floating body, the floating body being assigned at least one luminous means with an energy source and a switching element for the activation of the luminous means. Accordingly, at least the luminous means or else, if appropriate, a plurality of luminous means, the energy source and the switching element are formed as a tight luminous unit. By combining the luminous means, the energy source and the switching element, the electrical component parts that are indispensable for the operation of the light signal can be handled as a compact unit and are preferably sealed at least in gas- or watertight fashion from the surroundings, such that the electrical components are reliably protected against ingress of moisture. The luminous unit is exchangeable as a compact part particularly in the event of a malfunction, such that the defective luminous unit can simply be replaced by a new luminous unit. Accordingly, the production and the handling as well as the maintenance of the light signal overall are simplified and rationalized since, in particular, it is no longer necessary to make any interventions into the floating body.

The luminous unit can preferably be releasably connected to the floating body, such that a secure connection between the luminous unit and the floating body can be produced, which connection can however be released at any time, for example for repair purposes. A battery change or exchanging the luminous means therefore takes place only on the individual luminous unit and not on the floating body.

In one preferred development of the invention, the luminous unit is assigned a tight housing. The housing forms an encapsulation of the luminous unit, protects the luminous unit against mechanical stresses and seals it at least in watertight fashion towards the outside.

The floating body preferably has at least one externally accessible receptacle for the luminous unit, it being possible to provide a dedicated receptacle for each luminous unit assigned to a floating body or else a common receptacle for a plurality of luminous units. The fact that the receptacle is externally accessible means that the luminous unit can be inserted into or connected to the floating body without opening the latter, the receptacle preferably being able to receive the luminous unit at least partly. The receptacle is preferably formed such that it can also receive the housing of the respective luminous unit. It is thus ensured that only parts of the luminous unit which are necessarily externally visible or freely accessible, such as a transparent covering of the luminous means, project from the floating body and the rest of the luminous unit is situated in protected fashion in the floating body.

The luminous unit or preferably the housing of the luminous unit can furthermore be releasably connected to the receptacle in the floating body. Consequently, the luminous unit can be inserted into the receptacle and in the latter can be connected to the floating body preferably by fixing means arranged there. On account of the releasability of the connection, which may be formed for example in the form of a plug-in, latching or screw connection or in some other suitable manner, the luminous unit can easily be exchanged as required.

The housing of the luminous unit preferably has a plurality of parts, in particular a preferably cylinder-like lower part and an upper part preferably formed like a hemisphere or dome. The lower part of the housing is able to be accommodated in particular in the receptacle of the floating body, while the upper part preferably projects upwards from the receptacle of the floating body. The subdivision permits a structural configuration corresponding to the intended use, and permits the use of different materials in conjunction with simple production of the housing.

Preferably, the luminous means is arranged in the region of the upper part of the housing of the luminous unit, in particular centrally in the interior of the upper part. By virtue of the fact that the upper part of the housing projects from the receptacle of the floating body, it is situated above the surface of the water in the floating state of the floating body.

The upper part of the housing of the luminous unit is furthermore preferably formed in translucent fashion, preferably in transparent fashion. By way of example, plastics such as polyethylene or polycarbonate, or else other transparent materials such as glasses or glass composites, for example, are suitable as materials for the transparent embodiment of the upper part of the housing. The transparent embodiment of the upper part of the housing means that the light emitted by the luminous means in the interior can be emitted freely into the surroundings of the luminous unit.

The housing preferably has a seal, which may be formed as a sealing ring, for example, between the upper part and the lower part. The seal may serve for sealing the receptacle in the floating body by means of the housing of the luminous unit that is inserted into the receptacle, such that no liquid can penetrate into the receptacle. The seal furthermore makes it possible to secure the releasable connection between the housing of the luminous unit and the receptacle by virtue of its inhibiting the release of the connection for example by means of a clamping force and/or friction force.

The switching element is preferably able to activate or deactivate the luminous means of the luminous unit in an inclination-dependent manner. The light signal is automatically switched on by the switching element in the floating or upright state, while it is stored in a manner turned upside down in the standby state on board a ship, such that the switching element switches off the luminous means. The switching element may be formed as an inclination switch, in particular mercury switches, magnetically operated switches or the like being suitable for this. A mercury switch is a reliable switching element. By way of example, a reed contact that is switchable with the aid of a magnet can preferably be used as a magnetically operated switch. Other electronic switching elements operating for example with hall sensors or the like are also conceivable.

The switching element can preferably be activated or inactivated by a movable switching means. A conceivable movable switching means is a magnet, for example, which is brought into proximity to a switching element, such as a magnetically operated switch, and thus switches on the switching element and, at a sufficient distance therefrom, switches it off. Consequently, a reliable inclination switch with simple components can easily be produced in which the switching means moves away from or approaches the switching element for example on account of the force of gravity.

The switching means can be arranged in movable fashion in a small tube, such that the switching means can move only along a predetermined path or in a predetermined spatial region. As a result of a movement of the switching means on a preferably linear path, it approaches or moves away from the switching element for activation or deactivation thereof.

The small tube can additionally be filled with a fluid medium, such as a viscous liquid or a gas, such that the switching means can move for example on account of the influence of the force of gravity not in free fall but rather only in a manner decelerated by the small tube.

The small tube can preferably either be arranged fixedly in the interior of the housing or be able to be inserted into at least one externally freely accessible and for this purpose at least watertight cutout of the housing. A fixed arrangement in the interior of the housing permits a compact and maintenance-free construction of the luminous unit in the housing. If, by contrast, the small tube can be inserted externally into the cutout of the housing, it can be removed from the housing for transport purposes, for example, in order to prevent inadvertent switching on.

The housing preferably has at least two cutouts, the switching element being able to be switched by the switching means only when the small tube is arranged in one of the cutouts. By virtue of the fact that the switching means in the small tube is not able to activate the switching element when the small tube is arranged in at least one of the cutouts, said at least two cutouts bring about a reliable transport safeguard against inadvertent switching on of the luminous means, in which case the switching means can remain at or in the luminous unit.

In particular, a securing pin can also be able to be inserted into a single tight, externally accessible cutout of the housing in order thus to deactivate the switching means. The securing pin can be produced from a magnetic material, for example, and thus be inserted into the housing cutout situated between switching means and switching element or in concrete terms between magnetically operated switch and magnet, such that the force effect of the switching means on the switching element is shielded by the securing pin, and the switching element therefore cannot be activated.

The luminous means is preferably formed by at least one light-emitting diode (LED). A light-emitting diode constitutes a power-saving and robust alternative to normal incandescent lamps, such that less powerful and smaller energy sources can be installed in the luminous unit without any losses of light intensity. Preferably, the light-emitting diode is assigned at least one diverging lens in order to achieve uniform, large area light emission of a light-emitting diode. For this purpose, the diverging lens distributes the light from a restricted solid angle range of the light-emitting diode of typically 100-140° into a significantly larger range.

The diverging lens is preferably formed from a transparent or translucent, preferably pellucid, material, such as a plastic. Polycarbonate is particularly suitable for this, but it is also possible to use other materials, if appropriate, also glasses, having a sufficiently high refractive index for light, where for example a refractive index of $n=1.58$ is typical in the case of polycarbonate. The corresponding configuration of the diverging lens from a transparent material produces a good luminous efficiency without high absorption losses in the material. At the same time, a small structural size of the lens is achieved by means of a high refractive index of the material used.

Preferably, the diverging lens has in its interior a cutout for receiving the at least one light-emitting diode, the cutout being formed in particular in positively locking fashion with regard to the housing of the respective light-emitting diode or for optimization of the light scattering. On account of the arrangement of the light-emitting diode in the interior of the diverging lens, it is possible to adapt the diverging lens to the light emission of the light-emitting diode. In particular, the diverging lens is formed essentially rotationally symmetrically with respect to the main emission direction of the light-emitting diode, thereby enabling the light emitted by the light-emitting diode to be scattered uniformly into the space surrounding the light-emitting diode.

The diverging lens scatters as uniformly as possible in particular at least part of the light emitted by the light-emitting diode into an essentially at least hemisphere-like spatial region. Preferably, this means that the at least hemispherical spatial region can be illuminated essentially homogeneously. The applicable seafaring regulations, in particular SOLAS, are fulfilled by means of this illumination as homogeneously as possible with a sufficient light intensity.

A further object of the invention is to provide a luminous unit which is suitable in particular for use in a light signal as described above, and has at least one luminous means, at least one energy source and at least one switching element. Such a luminous unit is characterized by at least one luminous means, at least one energy source, and at least one switching element. At least the luminous means, the energy source and the switching element are in this case arranged in a tight housing of the luminous unit. Furthermore, the luminous unit can have various features from among those discussed above.

BRIEF DESCRIPTION OF THE DRAWINGS

Two preferred exemplary embodiments of the invention are explained below with reference to the drawing, in which.

DETAILED DESCRIPTION OF PREFERRED EMBODIMENTS

Figure 1:
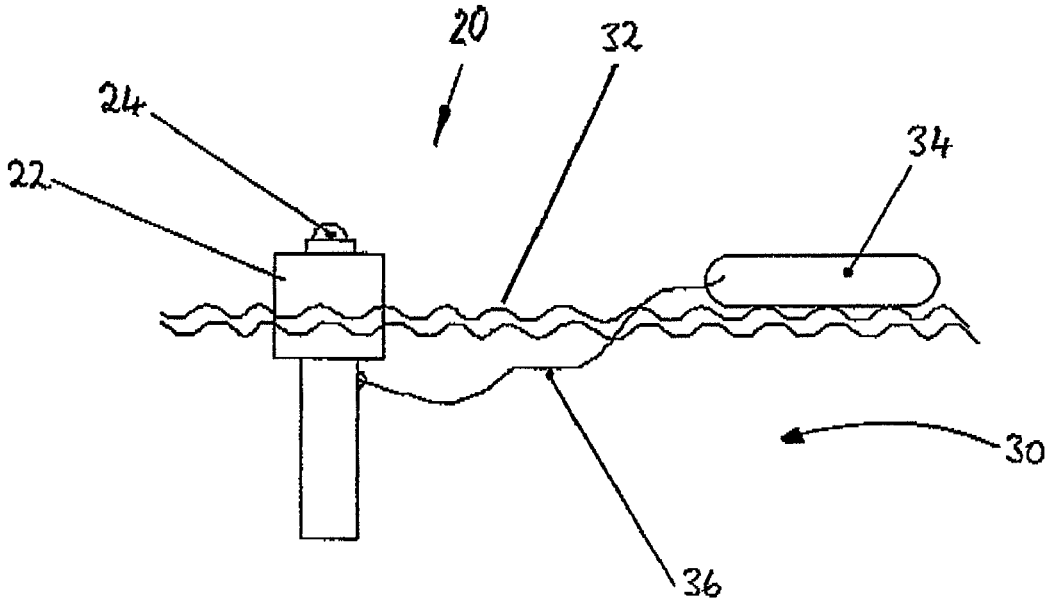
FIG. 1 shows a side view of a floating light signal according to the invention in the form of a maritime emergency light signal with a rescue means fixed thereto.
Figure 2:
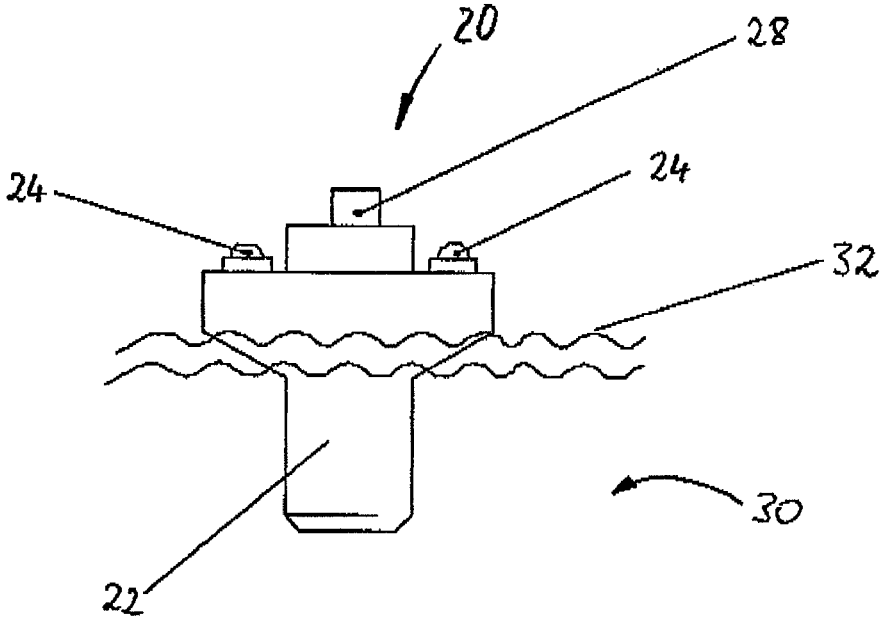
FIG. 2 shows a side view of a floating light signal according to the invention in the form of a maritime emergency light signal with smoke signal generator.

A light signal 20 according to the invention for signaling acute emergency situations at sea has a floating body 22, in order to be buoyant. The floating body 22 can be formed in various ways, as shown by the alternative embodiments as maritime emergency light signal in FIG. 1 and as maritime emergency light signal in FIG. 2. The light signal 20 shown in FIG. 1 is also designated as a maritime emergency night light. The floating body 22 is formed as a hollow body having a single cavity or a plurality of cavities and is thereby buoyant in water. However, the floating body 22 can also be formed from buoyant materials, for example foamed plastic. A self-maintaining orientation of the floating body 22 in a preferred position in the water 30 can be achieved by means of a suitable embodiment and, if appropriate, a targeted use of weights, such that at least an upper end region of the floating body 22 is situated above the surface 32 of the water, and the floating body 22 essentially maintains its upright position even during wave movements.

Figure 3:
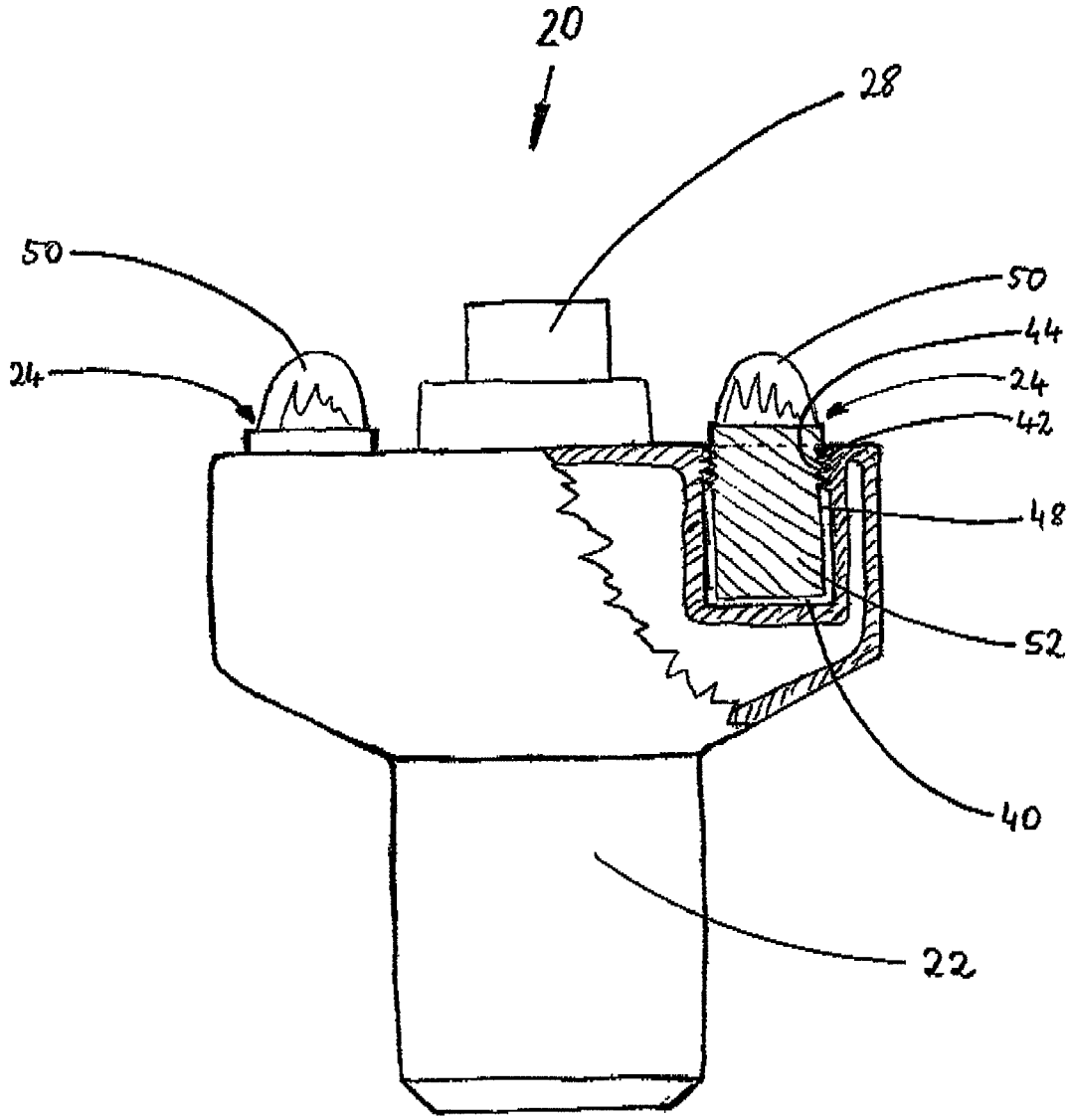
FIG. 3 shows a partial section through the light signal from FIG. 2.

Depending on the embodiment of the light signal 20, one or a plurality of luminous units 24 are arranged in the upper region of the light signal 20. In the case of the maritime emergency light signal in FIG. 1, the single luminous unit 24 is situated on the longitudinal center axis 26 of the floating body 22. In the case of the maritime emergency light signal in FIGS. 2 and 3, the floating body 22 is assigned two luminous units 24, a smoke signal generator 28 also being arranged between the two luminous units 24 on the longitudinal center axis 26. In order to connect the light signal 20 to a rescue means 34, a cord 36 fixed to the rescue means 34 can furthermore be fixed to the floating body 22 with the aid of a fixing means 38, such as an eye or a hook (FIG. 1).

A receptacle 40 is formed in the floating body 22 for each luminous unit 24 assigned to the light signal 20, said receptacle being sealed with respect to the floating body 22, such that no liquid can penetrate through it into the interior of the floating body 22. For fixing the luminous unit 24, a screw thread 42 is provided in the upper region of the receptacle 40, said screw thread corresponding to a corresponding screw thread 44 of the luminous unit 24, such that the latter can be inserted into the receptacle 40 and be fixedly screwed therein. In order to secure the screw connection against inadvertent release and as additional protection against ingress of liquid into the receptacle 40, a sealing ring 46 is arranged on the luminous unit 24, which sealing ring comes into contact with the receptacle 40 when the luminous unit 24 is screwed into said receptacle, and in this case fulfils a securing and sealing effect by means of positively locking and clamping bearing.

The housing 48 of the luminous unit 24 is subdivided into a plurality of regions. An upper dome part 50 preferably projects from the receptacle 40 of the floating body 22 and has an essentially hemisphere-like form. The lower part of the housing 48 is formed by a foot part 52, which is situated completely within the receptacle 40 when the luminous unit 24 is mounted in the receptacle 40. The sealing ring 46 and the screw thread 44 are arranged in the upper region of said foot part 52.

Figure 4:
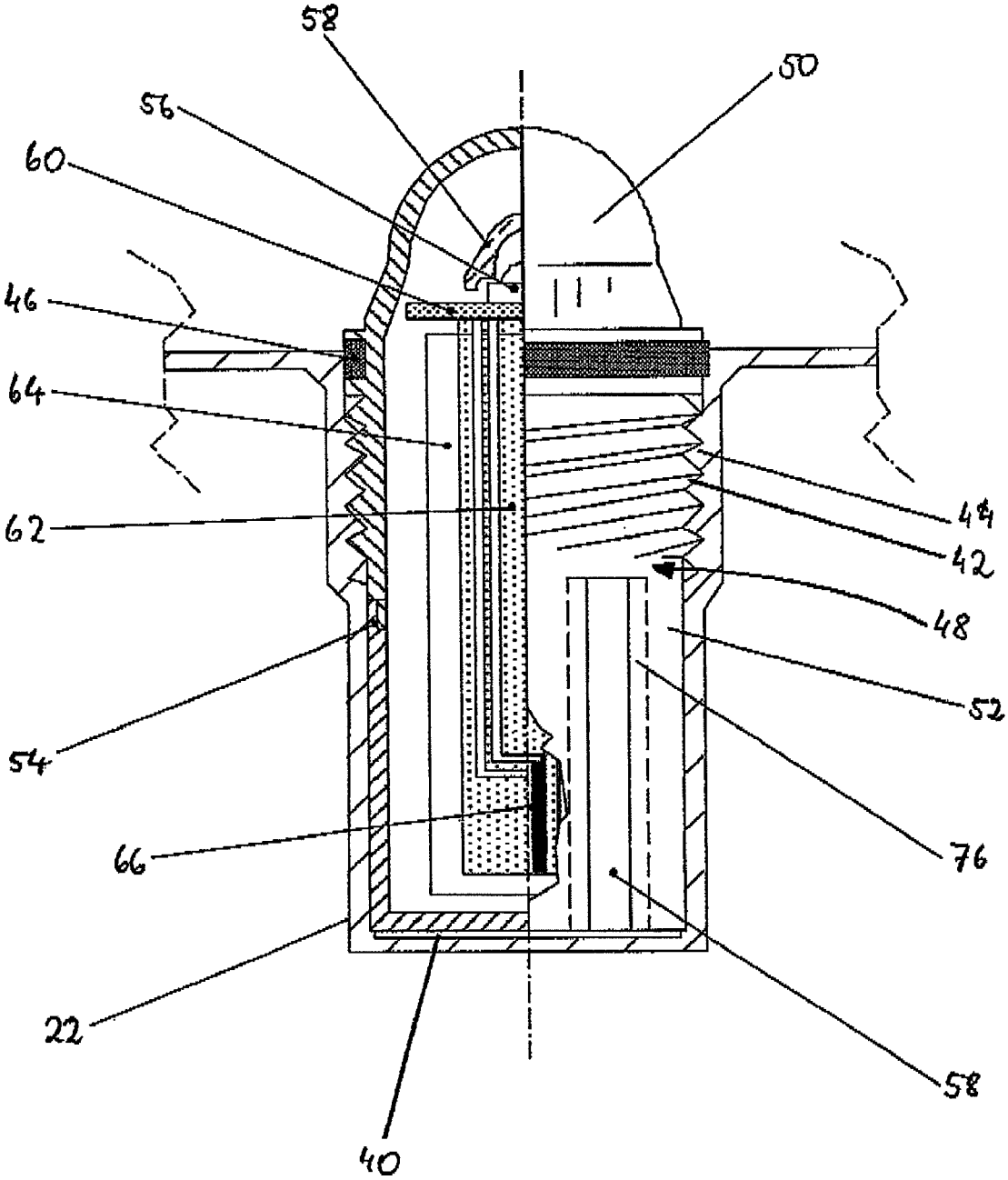
FIG. 4 shows a partial section of a luminous unit according to the invention in a side view.
Figure 7:
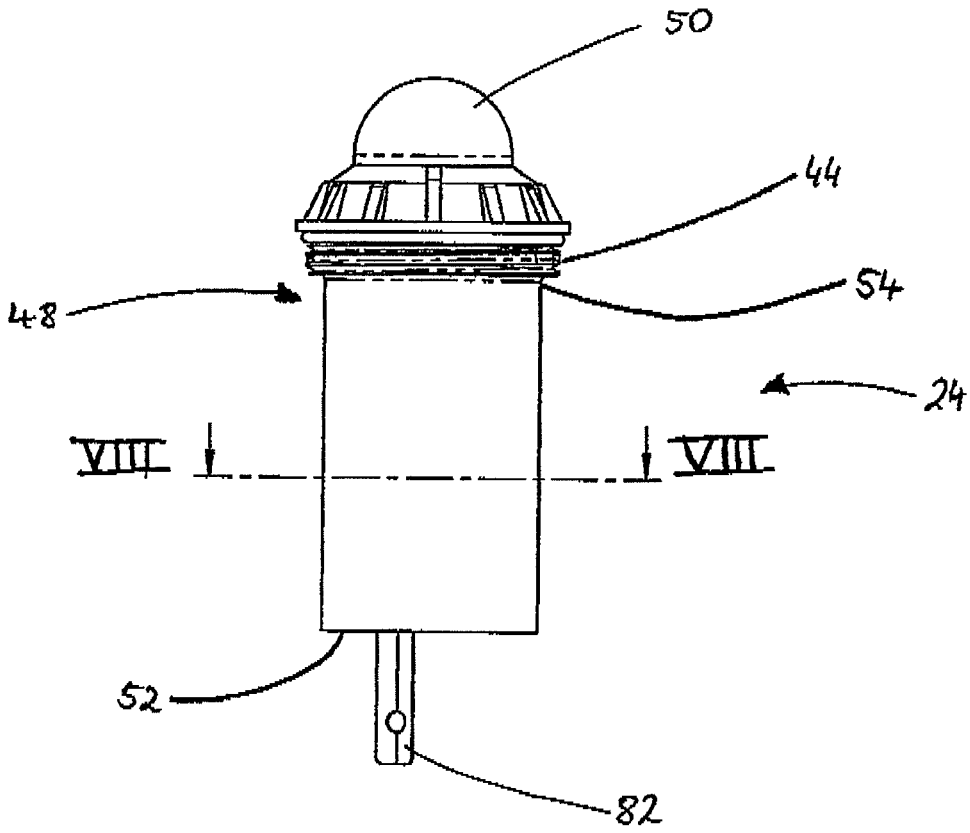
FIG. 7 shows a side view of a luminous unit in accordance with a second exemplary embodiment of the invention.
Figure 8:
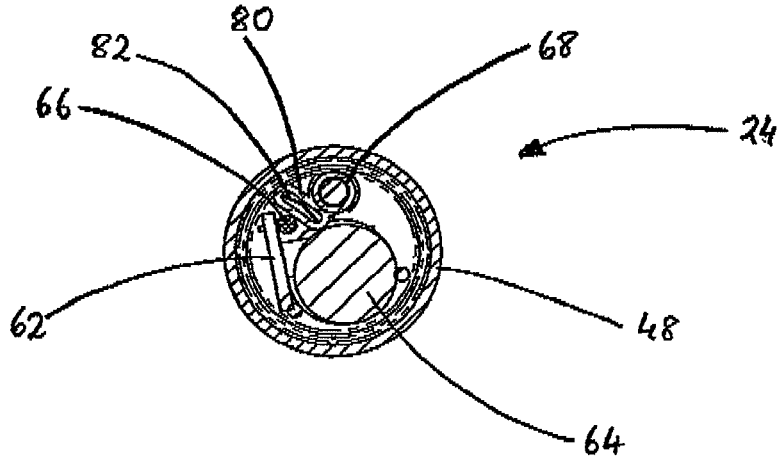
FIG. 8 shows a cross section VIII-VIII through the luminous unit from FIG. 7.
Figure 9:
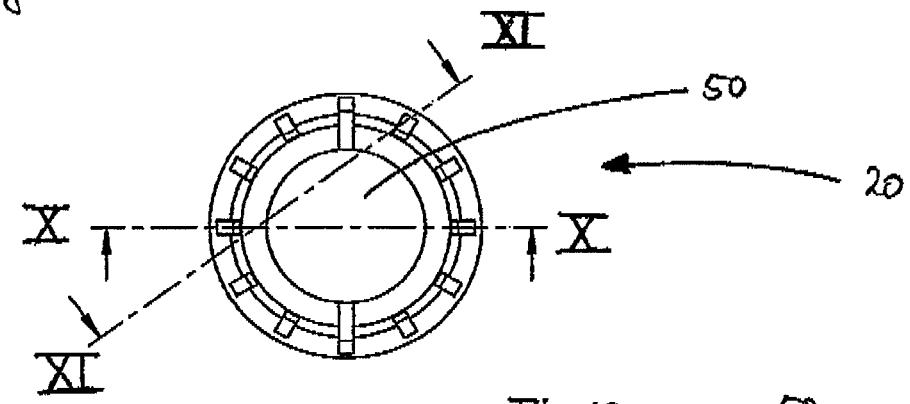
FIG. 9 shows a plan view of the luminous unit from FIG. 7.
Figure 10:
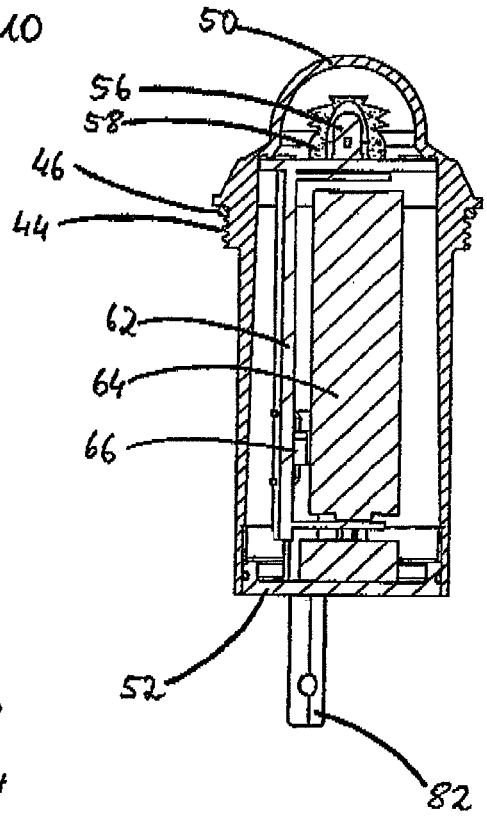
FIG. 10 shows a longitudinal section X-X through the luminous unit from FIG. 9.

The housing 48, which is formed in hermetically sealed fashion, is composed of a plurality of components. These may be for example two halves of the housing 48, as is shown in FIG. 4. An upper half, which comprises the dome part 50, and a lower half having a part of the foot part 52 are permanently and tightly connected to one another by a weld 54, for example a friction weld or radio-frequency weld. In another embodiment of the luminous unit 24, as is shown in FIG. 7, for example, such a connection in the form of a weld 54 can also be arranged in the region between dome part 50 and foot part 52, however. Composition from more than two parts is also conceivable, in the same way as other types of connection, such as adhesive bonding or the like, can be used.

The components required for the operation of the luminous unit 24 are arranged in the interior of the housing 48. A light-emitting diode 56 serving as light source is situated in the interior of the dome part 50. In order to scatter the comparatively directional light emission of the light-emitting diode 56 at an angle of typically 100° to 140° into a solid angle range of at least 180°, that is to say a hemisphere-like region, a diverging lens 58 is arranged around the light-emitting region of the light-emitting diode 56. On account of multiple light refraction, the diverging lens 58, which is produced from a transparent or translucent material such as polycarbonate, for example, is able to scatter the light emitted by the light-emitting diode 56 essentially homogeneously at least in all directions of the hemisphere-like region of the dome part 50.

Figure 11:
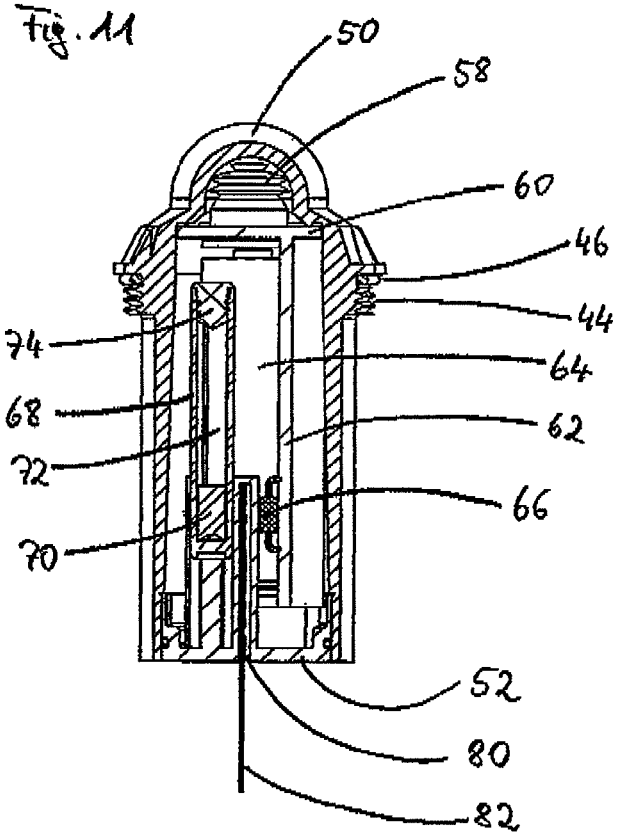
FIG. 11 shows a longitudinal section XI-XI through the luminous unit from FIG. 9.
Figure 12:
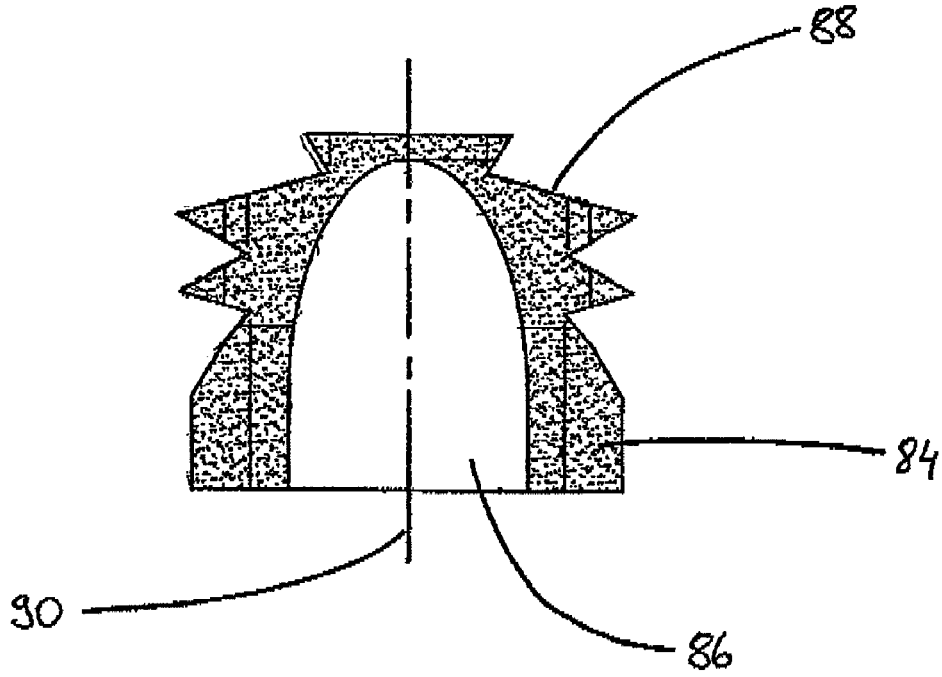
FIG. 12 shows a longitudinal section through a diverging lens according to the invention.
Figure 13:
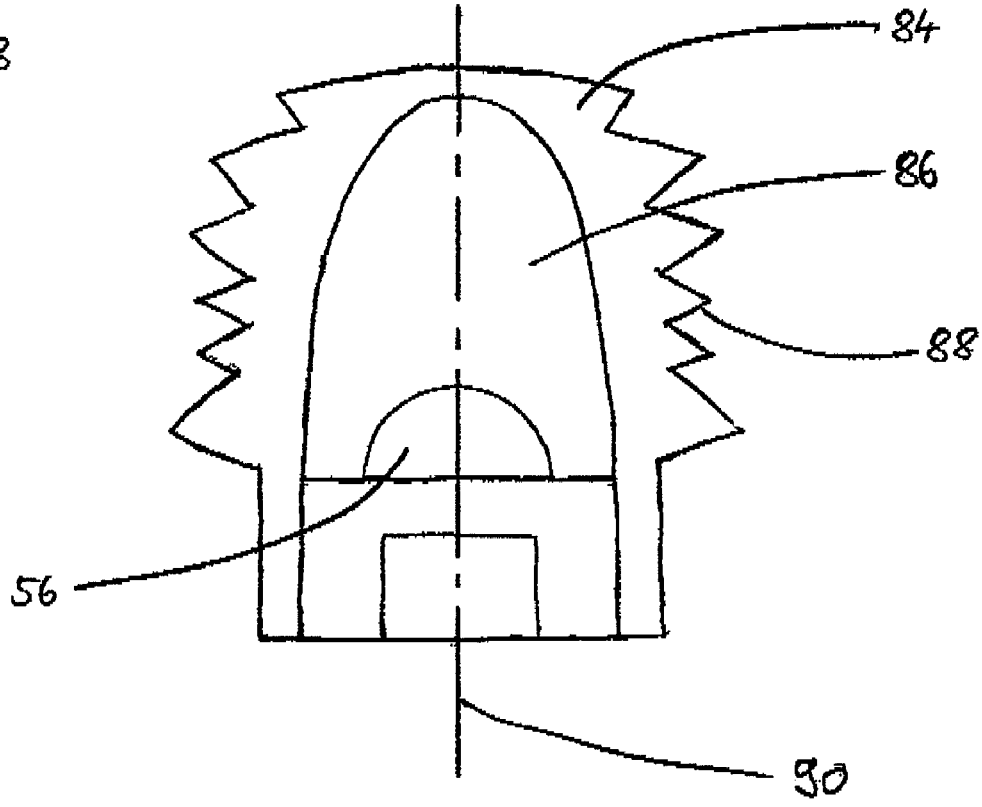
FIG. 13 shows a longitudinal section through a diverging lens according to the invention in an alternative embodiment.

The diverging lens 58 has a lens body 84 produced from transparent, pellucid material, polycarbonate in this case. A cavity 86 is cut out in the interior of said lens body 84, into which cavity the light-emitting diode 56 can be inserted. The cavity 86 has a parabolic form in section. By contrast, the outer contour 88 of the lens body 84 has a jagged appearance in longitudinal section. Since the diverging lens 58 is constructed essentially rotationally symmetrically with respect to its longitudinal center axis 90, this accordingly results in a construction of the lens body 84 in the manner of a Fresnel lens, such as can be discerned for example in FIGS. 11 and 12. Peripheral prism-like shaped portions are arranged on the outer periphery of the diverging lens 58.

The light refraction at the transition from the cavity 86 to the lens body 84 and the second light refraction at the transition from the lens body 84 at the contour 88 to the surroundings and the large refractive index of the material used for the lens body 84 (polycarbonate n=1.58) enable the light that is essentially emitted upwards by the light-emitting diode 56 to be scattered into at least one hemisphere-like spatial region above the horizontal, that is to say at least parallel to the surface 32 of the water.

The light-emitting diode 56 is arranged on a horizontally arranged printed circuit board 60 connected to a vertical printed circuit board 62, on which a battery 64 and a reed contact 66 are fixed. The light-emitting diode 56, the battery 64 and the reed contact 66 are electrically connected with the aid of conductor tracks or wires in such a way that the light-emitting diode 56 is supplied with electrical power by the battery 64 when the reed contact 66 is switched on. The reed contact 66 can be switched on by a magnet 70 which is arranged in movable fashion in a small tube 68, if the magnet 70 is in proximity to the reed contact 66. The small tube 68 is filled with a damping liquid 72 for damping rapid movements of the magnet 70. In order to prevent the damping liquid 72 from escaping and at the same time to prevent gases or liquids from penetrating, the small tube 68 is tightly sealed with a stopper 74 at its open end region.

Figure 5:
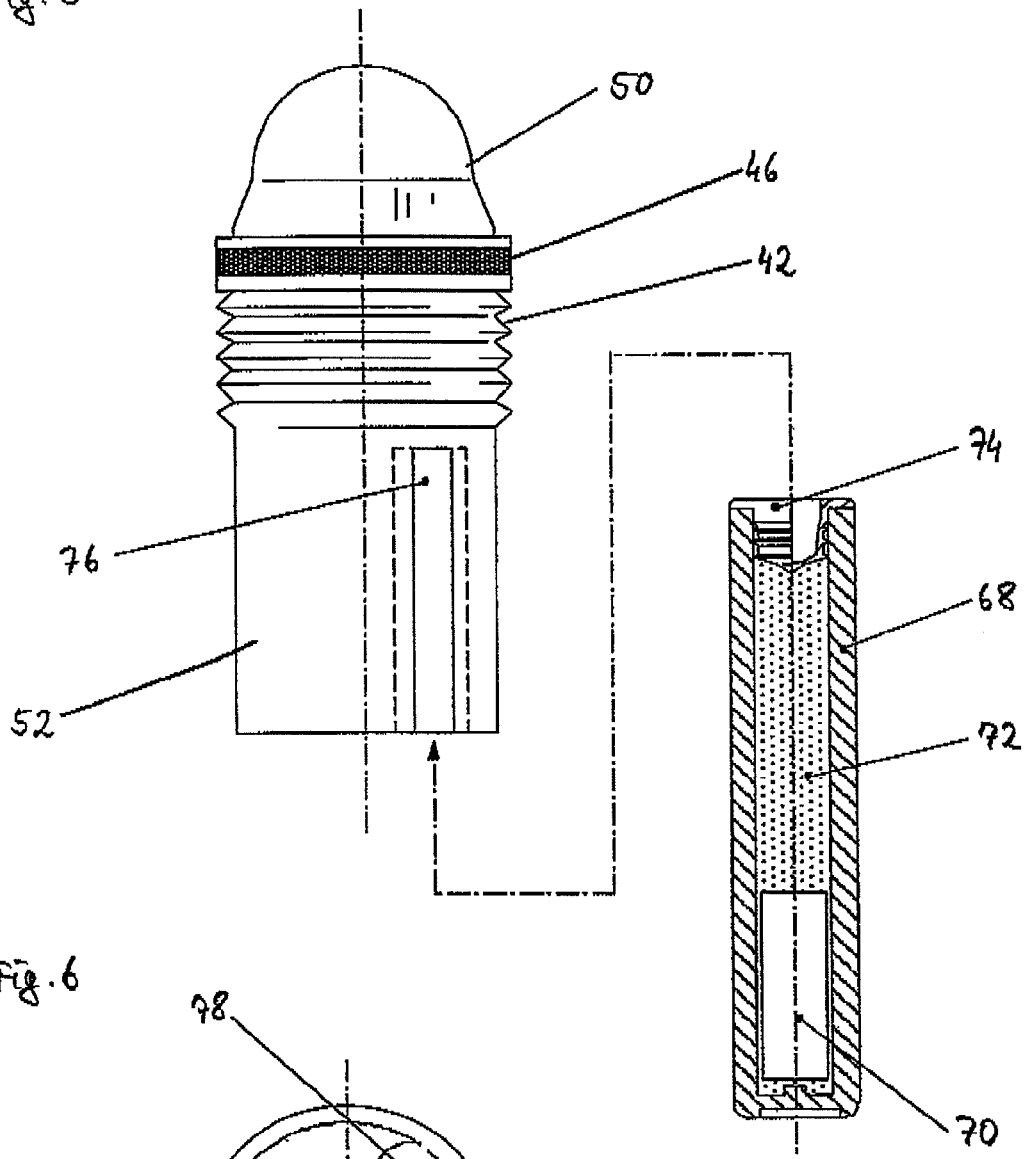
FIG. 5 shows a side view of a luminous unit according to the invention with a small tube for activating or deactivating the switching element of the luminous unit.
Figure 6:
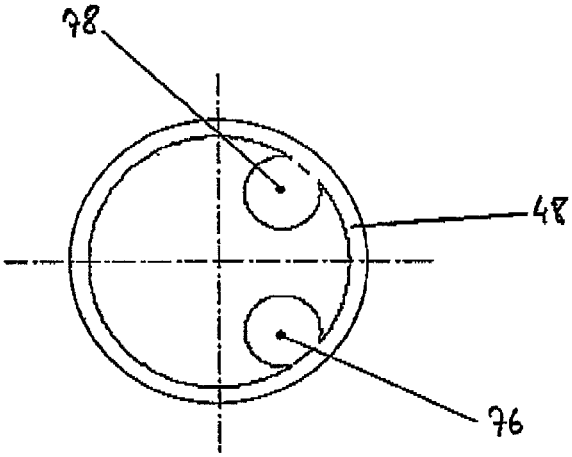
FIG. 6 shows a view of the luminous unit in accordance with FIG. 5 from below.

A first embodiment of the luminous unit 24 according to the invention is described in more detail below in FIG. 4 to FIG. 6. In this case, two externally accessible cutouts 76 and 78 are formed in the housing 48, the opening of said cutouts in each case being situated in the bottom region of the foot part 52 of the housing 48. The small tube 68 can in each case be completely inserted into said cutouts 76 and 78. The cutouts 76 and 78 are formed tightly such that no water can pass through them into the floating body 22. The cutout 76 is arranged in proximity to the reed contact 66, such that the magnet 70, if it is situated at an end of the small tube 68 situated closest to the reed contact 66, can switch the latter on, and if the magnet 70 is situated at the other end of the small tube 68, the reed contact 66 cannot be switched on. If the small tube 68 with the magnet 70 is arranged in the second cutout 78, the magnet 70 in any possible position within the small tube 68 is situated too far away from the reed contact 66, such that the magnet 70 cannot switch the latter on even if the light signal 20 is in the floating position. Consequently, a simple and effective safeguard against inadvertent switching on, such as is required for example for transport and storage purposes, is afforded by changing over the arrangement of the small tube 68.

On account of the force of gravity acting downwards, the magnet 70 is situated in the respective lower region of the small tube 68, as can be seen in the figures. In this position, the magnet 70 is closest to the reed contact 66, such that the latter can switch on. If the luminous unit 24 together with the small tube 68 is then rotated for example by more than 90°, for example turned upside down through 180°, the magnet 70, on account of the force of gravity, moves to the opposite end of the small tube 68 and therefore moves away from the reed contact 66, such that the magnet 70 can no longer switch the reed contact 66 on owing to the greater distance from said reed contact. Upside down storage of the luminous unit 24, even if it is mounted in the floating body 22, thus provides for the luminous unit 24 to be switched off. As soon as the floating body 22, together with the luminous unit 24, is in water, the floating body 22 turns into its essentially upright position in floating fashion. Consequently, the luminous unit 24 is also in the upright position represented, such that the magnet 70 moves to the lower end of the small tube 68 and, as described above, switches on the reed contact 66 for activating the light-emitting diode 56.

An alternative embodiment of the invention is shown in FIGS. 7 to 11, in which the small tube 68 with the magnet 70 is arranged fixedly in the interior of the housing 48 of the luminous unit 24, such that in this case, too, the magnet 70 can switch on the reed contact 66 at one end of the small tube 68 and the light-emitting diode 56 is switched off at the other end of the small tube 68.

In this exemplary embodiment, an externally accessible but tight pin receptacle 80 is formed in the housing 48 in the region between the small tube 68 and the reed contact 66, into which receptacle a securing pin 82 can be inserted. Said securing pin 82 is situated between the reed contact 66 and the small tube 68 within the pin receptacle 80, such that the securing pin 82, which is produced from magnetic material, shields the reed contact 66 from the magnetic field of the magnet 70, such that the magnet 70 now cannot switch on the reed contact 66 in any position within the small tube 68. Consequently, in this embodiment, too, a safeguard against inadvertent switching on for example during transport of the light signal 20 is provided, which can be eliminated by removing the securing pin 82 and activates the reed contact 66.

The securing pin 82 inserted into the pin receptacle 80 preferably projects beyond the edge of the housing 48, such that it can be removed easily, on the one hand, and by means of appropriate formation of the corresponding receptacle 40 in the floating body 22, prevents the luminous unit 24 from being inserted into the receptacle 40. Consequently, before the luminous unit 24 is incorporated into the floating body 22, the securing pin 82 must firstly be removed in order to bring the luminous unit 24 into an activatable state.

The invention described above is not restricted to the exemplary embodiments shown, such that other embodiments are also conceivable. By way of example, the luminous unit 24 can be used for floating bodies 22 formed in any different fashion.

LIST OF DESIGNATIONS

20 Light signal
22 Floating body
24 Luminous unit
26 Longitudinal center axis
28 Smoke signal generator
30 Water
32 Surface of water
34 Rescue means
36 Cord
38 Fixing means
40 Receptacle
42 Screw thread
44 Screw thread
46 Sealing ring
48 Housing
50 Dome part
52 Foot part
54 RF weld
56 Light-emitting diode

58 Diverging lens
60 Printed circuit board
62 Printed circuit board
64 Battery
66 Reed contact
68 Small tube
70 Magnet
72 Damping liquid
74 Stopper
76 Cutout
78 Cutout
80 Pin receptacle
82 Securing pin
84 Lens body
86 Cavity
88 Contour
90 Longitudinal center axis

What is claimed is:

1. Light signal (20), in particular a maritime emergency signal, comprising a floating body (22), the floating body (22) having at least one luminous means with an energy source and a switching element for the activation of the luminous means, wherein the luminous means, the energy source and the switching element are formed as a tight luminous unit (24), wherein the floating body (22) has an externally accessible receptacle (40) for the luminous unit (24), and wherein the luminous unit (24) is releasably connected to the receptacle (40) in the floating body (22) without opening the floating body (22).

2. Light signal (20) according to claim 1, wherein the luminous unit (24) is releasably connected to the floating body (22).

3. Light signal (20) according to claim 1, wherein the luminous unit (24) has a tight housing (48).

4. Light signal (20) according to claim 1, wherein the housing (48) of the luminous unit (24) has a lower part and an upper part formed like a dome, the lower part being able to be accommodated in the receptacle (40) of the floating body (22) and the upper part projecting upwards from the receptacle (40) of the floating body (22).

5. Light signal (20) according to claim 4, wherein the luminous means is arranged in the region of the upper part of the housing (48), and the upper part of the housing (48) of the luminous unit (24) is at least translucent.

6. Light signal (20) according to claim 4, wherein the housing (48) has, between the upper part and the lower part, a seal for sealing the receptacle (40) by means of the housing (48) of the luminous unit (24).

7. Light signal (20) according to claim 1, wherein the switching element activates and deactivates the luminous means of the luminous unit (24) in an inclination-dependent manner by a movable switching means.

8. Light signal (20) according to claim 7, wherein the switching means is arranged in movable fashion in a small tube (68), the small tube (68) being arranged fixedly in the interior of the housing (48).

9. Light signal (20) according to claim 7, wherein the switching means is arranged in moveable fashion in a small tube (68), the small tube (68) being insertable into two externally freely accessible, tight, cutouts (76, 78) of the housing (48), the switching element being able to be switched by the switching means only when the small tube (68) is arranged in one of the cutouts (76, 78).

10. Light signal (20) according to claim 8, wherein a securing pin (82) is insertable into a tight, externally accessible cutout (76) of the housing (48) for the purpose of deactivating the switching means.

11. Light signal (20) according to claim 1, wherein the luminous means is formed by at least one light-emitting diode (56), which is assigned a diverging lens (58).

12. Light signal (20) according to claim 11, wherein the diverging lens (58) has in its interior a cutout for receiving the at least one light-emitting diode (56).

13. Light signal according to claim 11, wherein the diverging lens (58) is formed rotationally symmetrically with respect to the main emission direction of the light-emitting diode (56).

14. Light signal (20) according to claim 11, wherein the diverging lens (58) scatters as uniformly as possible at least part of the light emitted by the light-emitting diode (56) into a at least hemisphere-like spatial region.

15. Luminous unit (24) for use in a light signal (20), comprising at least one luminous means, at least one energy source and at least one switching element, wherein at least the luminous means, the energy source and the switching element are arranged in a tight housing (48).

16. Luminous unit (24) comprising at least one luminous means, at least one energy source and at least one switching element, wherein at least the luminous means, the energy source and the switching element are arranged in a tight housing (48).

* * * * *